United States Patent [19]

Tobin

[11] 4,251,093

[45] Feb. 17, 1981

[54] RESTAURANT CHECKS

[76] Inventor: Philip C. Tobin, Box 726, Bar Harbor, Me. 04609

[21] Appl. No.: 8,486

[22] Filed: Feb. 2, 1979

[51] Int. Cl.[3] ..... B42D 15/00

[52] U.S. Cl. ..... 283/60 A; 283/44; 283/48 R; 434/191

[58] Field of Search ..... 35/30, 31 R, 31 A, 31 B, 35/31 C, 31 D, 31 E, 31 F, 31 G; 283/44, 48 R, 48 A, 49, 60 R, 60 A, 63 A, 66 R

[56] References Cited

U.S. PATENT DOCUMENTS

| | | | |
|---|---|---|---|
| 1,896,255 | 2/1933 | Smithers | 35/31 R X |
| 3,377,717 | 4/1968 | Rowe | 35/31 R |

OTHER PUBLICATIONS

Cleo Learning Aids, Cleveland, Ohio–Catalogue *Educational Equipment Supplies Teaching Aids Furniture and Furnishings Special Education,* 1976, p. 39.

¼" Grid graph paper.

*Primary Examiner*—Paul A. Bell

[57] ABSTRACT

A restaurant check and method for recording and totalling itemized food costs comprising a sheet for receiving indicia having an operative format of separately delineated digit columns and a stepwise array of cell groups aligned below the vertical columns for a two step additive method of first recording complete totals of each vertical column in cell groups of the stepwise array and then summing the recorded column totals from the stepwise array in a horizontal cell row.

10 Claims, 3 Drawing Figures

RESTAURANT CHECKS

FIELD OF THE INVENTION

This invention relates to new and improved restaurant checks, and a new, improved format and method for recording and totaling itemized food costs which minimizes possibility for addition errors.

BACKGROUND OF THE INVENTION

The annual dollar loss absorbed by restaurant operators due to addition errors in dinner check totals results from difficulty adding in high stress, high distraction situations, at rush hour, for example. The three causes responsible for most dinner check addition errors are: column confusion; long column carry-over errors; and single column rechecks.

The problem of column confusion is solved by providing vertical lines in the format denoting the three most frequently used columns to eliminate drifting digits, an expedient not available in conventional restaurant checks. Eliminating the carry-over mistake problem is another matter, however, and again is unaddressed by conventional checks.

After studying the carry-over problem at some length, the present inventor learned that most carry-over errors occur after the time the employee notates the "units" digit of a column total and before that same employee writes down the "tens" digit of the column total at the top of the next-to-be-added column. These errors appear to be caused by distraction and intrusions that cause the waiter or waitress momentarily to forget the carry-over digit of the column total. When the employee is temporarily distracted by something happening around him or her, the eye stops for an instant in its movement to the top of the next column. If, in this split-second pause, the employee's eye happens to focus on a more easily remembered number than the number being carried over, a 2 say, when the carry-over digit is a 3; or a 3, when the carry-over digit is a 4 or a 5, then the waiter or waitress is likely mentally to change the carry-over with the result that an addition error will be made against the house. This phenomenon explains why most restaurant check errors are in fact against the house rather than in the house's favor.

It is an object of the present invention to eliminate distraction caused carry-over errors by making it possible to write down complete column totals as they are summed. A feature and advantage of the present invention is that once all the columns are totalled and recorded in this manner, they can be summed in a normal addition procedure to reach the total meal charge. Subsequently, the check total is reached by simply adding in liquor and sales tax charges, etc.

Furthermore, while most people can add correctly under normal stress-free conditions, they are prone to error when under pressure not to make mistakes, and it is this fear of making errors that usually is the cause of additional mistakes being made. It is therefore another object of the invention to eliminate much of this pressure by making it possible for the employee easily to check for addition errors without having to go back and add everything over again in the normal manner if there is any uncertainty as to whether he or she has reached an incorrect column total. The present invention virtually eliminates the carry-over error problem at the same time making long column re-checks quick and easy.

SUMMARY OF THE INVENTION

In order to accomplish these results, the present invention contemplates providing a sheet material substrate for receiving indicia, a plurality of n vertical columns formed on said sheet for recording itemized food costs in separate vertically aligned digit columns, and a plurality of n cell pairs or larger cell groups formed on the sheet means below the vertical columns for recording complete column sums separately. According to the invention, the cell pairs or groups are arranged in a vertical stepwise array, each pair offset one cell from each adjacent pair, and the stepwise array is aligned beneath the n vertical columns so that a single cell of one cell pair or group of the stepwise array falls beneath the righthand column of the vertical columns. As a result, a two or more digit number total for a particular column can be recorded completely in a corresponding cell pair or group aligned one cell beneath and the remainder to the left of said vertical column. A horizontal row of $n+1$ cells formed on the sheet means below the stepwise array is provided to record the total sum obtained by adding the column sums in the stepwise array.

A feature of the invention is that the addition process for long columns of itemized costs is broken down into separate and manageable digit column sums separately recorded eliminating carry-over between lengthy columns and the mental step at which error is most likely to intrude. A further advantage is that addition may be checked by re-check of separate columns without having to re-check the whole and without having to remember carry-over numbers during re-check.

According to the new and improved method of recording and totaling food costs on a restaurant check, the invention contemplates: a method of recording and totaling food costs on a restaurant check comprising: recording costs of itemized food items in a plurality of vertical columns of aligned digits; adding a first vertical column of digits and recording the sum of the digits in a space below the column so that the rightmost digit in the case of a multiple digit sum is aligned below said column with the remaining digits to the left; adding a second column of vertical digits and recording the sum of said digits in a space below said second column so that the rightmost digit in the case of a multiple digit sum is aligned below said second column with the remaining digits to the left whereby said second column sum is stepwise offset from the first column sum previously entered and placed above or below said first column sum; similarly adding the remaining columns and similarly entering and stepwise offsetting the remaining column sums until all the columns have been added and all the column sums recorded in a stepwise offset vertical array; and adding said column sums in the recorded stepwise array to give a final total equal to the sum of the item costs originally entered in the vertical columns of the restaurant check.

Other objects, features, and advantages of the present invention will become apparent in the following specification and accompanying drawings.

DESCRIPTION OF THE PREFERRED EMBODIMENT

Figure 1:
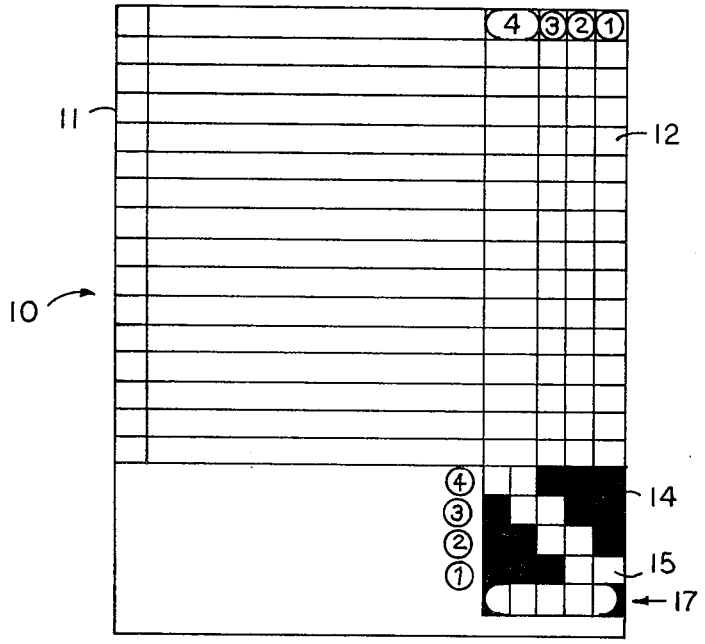
FIG. 1 is a plan view of a restaurant check formed in accordance with the present invention.

In the embodiment of the present invention illustrated in FIG. 1, the restaurant check 10 comprises a sheet 11 to which is imparted a physical structure as hereafter described for recording and totaling itemized food costs according to the format and method of the present invention. This functional format or structure imparted to the sheet 11 includes a plurality of vertical columns 12 for maintaining separate aligned columns of single digits. Counting from right to left, the columns are arranged so that the first column records units digits and the second tens digits, both comprising "cents". The third column records hundreds digits, and the fourth tens of hundreds digits, both together comprising dollars. This specific provision for separate column structures not available in conventional restaurant checks eliminates column drift in either the recordation or addition of the columns.

In the space 14 below the vertical columns an operative arrangement of cell pairs 15 is formed for receiving and recording complete column sums from the separate columns 12 of digits. As is shown, the cell pairs 15 are arranged vertically in a stepwise array, each pair offset one cell from the adjacent pair. As illustrated, the cell pairs are numbered 1–4, in this case from bottom to top and each number designation corresponds to the similarly designated vertical column above it. Each cell pair is positioned so that the righthand cell of the pair is aligned beneath the corresponding vertical column with the remaining cell to the left. Thus, cell pair number 1 is positioned with the righthand cell aligned beneath vertical column 1 etc. Below the stepwise array of cell pairs is formed a horizontal row 17 of five cells for entering and recording a final total obtained by adding the column sums entered in the stepwise array.

Figure 2:
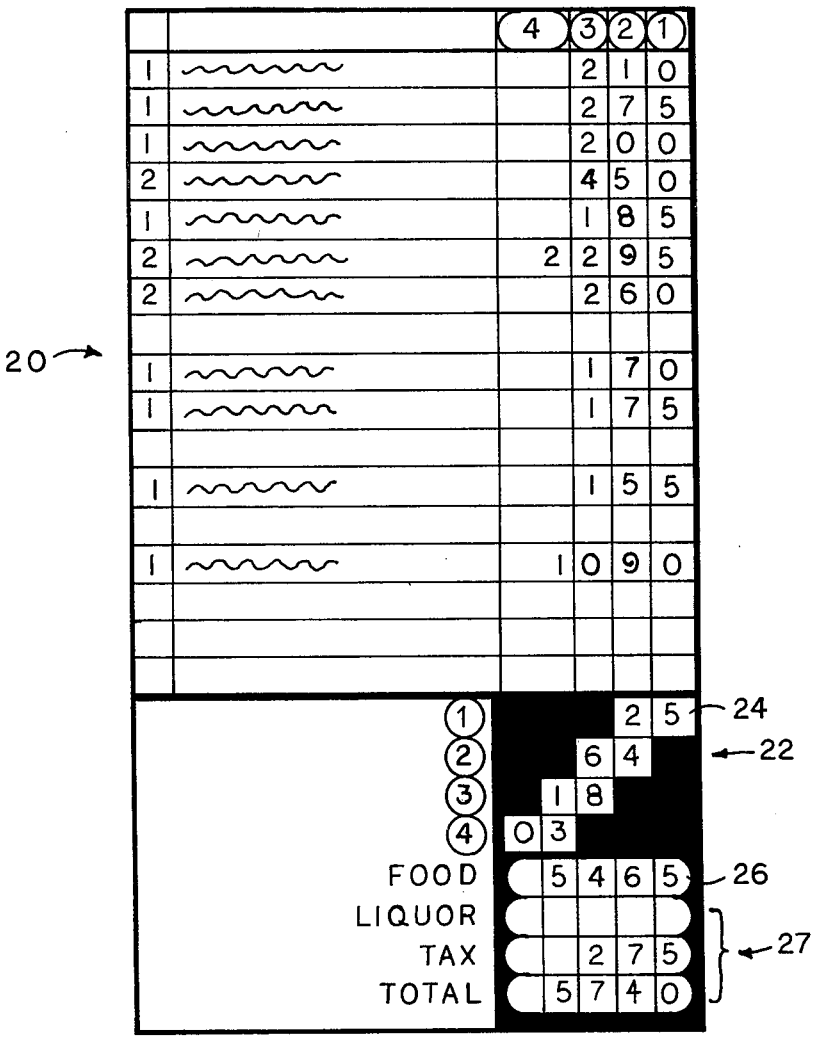
FIG. 2 is another restaurant check in accordance with the present invention but showing an alternate mirror image stepwise array of column sum cell pairs.

The operative features of the restaurant check invention and the new and improved method of recording and totaling itemized food costs on a restaurant check in accordance with the present invention are further illustrated with respect to a particular example in FIG. 2. In FIG. 2, there is illustrated a restaurant check 20 of slightly different embodiment in which the stepwise array 22 of cell pairs or cell groups 24 is inverted, in effect a mirror image of the stepwise array illustrated with reference to FIG. 1. With this slight rearrangement of structural format, however, there is no difference in principle or operation of the invention. It should be noted however, that the numbering designation of the cell pairs in the array must be reversed to coincide with corresponding vertical columns. Such numbering is an optional feature.

By way of example, a representative list of itemized food costs have been entered on the restaurant check 20 with the appropriate digits of each item entered in the appropriate columns 1–4. When the moment of reckoning comes, the waiter or waitress totals the digits in the first column and enters the complete sum in cell pair number 1. There are no carry-overs and no numbers to be remembered in a mental step going from one column to the next. The second column of digits is then totaled and the complete sum entered into the next stepwise adjacent cell pair and so on until all the columns have been separately totaled and entered in the corresponding cell pairs. Then, in a much simpler addition process, the stepwise recorded column sums are added and entered in the horizontal row 26 which includes digit entry cells in number one greater than the number of columns or cell pairs to permit entry of the complete total. Other horizontal rows 27 may also be provided for adding bar bill and tax, for example into a final total.

By this expedient it is seen that the process of totaling long columns of itemized food costs is broken down into a two step process in which first long columns are separately added and recorded without mental carry steps, and second the separate columns totals are added in a shorter and simpler addition step in which the carryover can be executed mentally with far less risk than takes place when adding long columns.

Figure 3:
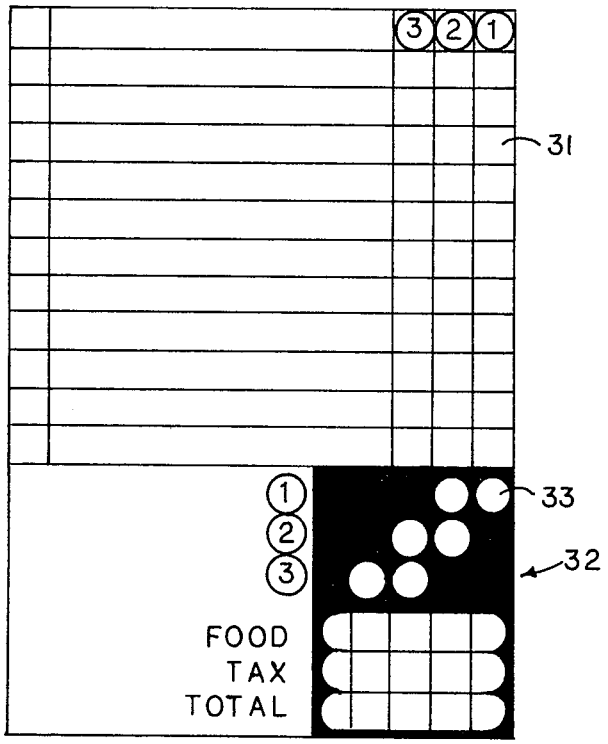
FIG. 3 is yet another restaurant check with a smaller number of vertical columns where smaller cost sums are anticipated and showing the use of round cells rather than square.

Another embodiment of the restaurant check invention is illustrated in FIG. 3 in which the restaurant check 30 is formed with a lesser number of operative columns 31 and in which the corresponding stepwise array 32 of cell pairs for recording complete column totals is comprised of circular cells 33. The use of circular cells further facilitates compartmentalization of particular digit entries to avoid error or confusion. It should be noted that in each of the embodiments, the stepwise array, whatever configuration is aligned below the vertical columns so that a single cell of one cell pair or group of the stepwise array falls beneath the righthand column of the vertical column. The digit total for that column, the units column, is recorded in this rightmost cell pair.

As illustrated in each of the embodiments of FIGS. 1–3, the cell pairs or groups arranged in the step wise array for receiving the individual column sums are set in a plain or contrasting background without any adjacent cells in the area of the array further facilitating accuracy and avoiding confusion in carrying out addition and checking operations using the device.

It is apparent from the examples presented that the present invention can be embodied in a number of formats and variations. For example, the number of vertical columns n can be varied according to the anticipated size of itemized cost totals as can the number of cells m in a cell set or group used to record the total for any particular column. Thus, in the examples presented cell pairs have been described, but groups or sets of three cells, for example, might be used in the stepwise array where longer columns and three digit column totals were involved. Furthermore, variations in cell size and column size and cell shape and column shape may be advantageous. As a particular example, in FIGS. 1 and 2, the fourth vertical column designated by the number 4 is of twice the width of the first three columns so that the two digit sum of the vertical column of digits in column 4 may be entered entirely beneath that column, which is the last column to the left. Other variations can be made within the scope of the restaurant check format and method of the present invention.

I claim:

1. A new and improved restaurant check comprising:

sheet material check means substrate for receiving indicia;

a plurality of n vertical columns formed on said sheet for recording itemized costs in vertically aligned digit columns;

a plurality of n cell pairs formed on the sheet means below said vertical columns, said cell pairs arranged in a vertical stepwise array, each pair offset one cell from each adjacent pair, said stepwise array of 2n paired cells aligned beneath the n columns formed on said sheet so that a single cell of one pair of the stepwise array falls beneath the righthand column of the vertical columns;

whereby a two digit total of digit indicia entered in each vertical column can be recorded in a corresponding cell pair aligned one cell beneath and one to the left of said vertical column;

said stepwise array of paired cells formed on a plain or contrasting background without any adjacent cells in the area of the array thereby facilitating accuracy and avoiding confusion during addition operations using the check;

and a horizontal row of n+1 cells formed on said sheet means below said stepwise array of n pairs of cells, said horizontal row aligned with said columns and stepwise array whereby the total sum obtained by adding the two digit sums in the stepwise array can be entered into the horizontal row.

2. A restaurant check as set forth in claim 1 wherein the nth vertical column counting from right to left is twice the width of the first n−1 columns so that the leftmost cell pair of the stepwise array falls within the width of the nth column whereby the digit sum for the nth column is recorded entirely beneath that column.

3. A restaurant check as set forth in claim 1 wherein said cells are square shaped having a width substantially equal to a digit column width.

4. A restaurant check as set forth in claim 1 wherein said cells are circular having a diameter substantially equal to a digit column width.

5. A restaurant check as set forth in claim 1 wherein said vertical columns are prominently numbered or designated from right to left and wherein the corresponding cell pairs are similarly numbered or designated to facilitate recording of column sums.

6. A new and improved restaurant check comprising:

sheet material check means substrate for receiving indicia;

a plurality of n vertical columns from right to left formed on said sheet means for recording itemized costs in vertically aligned digit columns from cents to dollars;

a plurality of n groups of m cells formed on the sheet means below said sheet means for recording itemized costs in vertically aligned digit columns from cents to dollars;

a plurality of n groups of m cells formed on the sheet means below said vertical columns, said cell groups arranged in a vertical stepwise array, each group offset one cell from each adjacent group, said stepwise array of nm (paired) grouped cells aligned beneath the n columns formed on said sheet so that a single cell of one group of the stepwise array falls beneath the righthand column of the vertical columns;

whereby an m digit total of digit indicia entered in each vertical column can be recorded in a corresponding cell group aligned with one cell beneath and the remainder to the left of said vertical column;

said stepwise array of grouped cells formed on a plain or contrasting background without any adjacent cells in the area of the array thereby facilitating accuracy and avoiding confusion during addition operations using the check;

and a horizontal row of cells formed on said sheet means below said stepwise array of n groups of cells, said horizontal row aligned with said columns and stepwise array whereby the total sum obtained by adding the m digit column sums in the stepwise array can be entered in the horizontal row.

7. A restaurant check as set forth in claim 6 wherein the nth vertical column counting from right to left is m times the width of the first n−1 columns so that the leftmost cell group of the stepwise array falls within the width of the nth column whereby the digit sum for the nth column is recorded entirely beneath that column.

8. A restaurant check as set forth in claim 6 wherein said cells are of square shape.

9. A restaurant check as set forth in claim 6 wherein said cells are of circular shape.

10. A restaurant check as set forth in claim 6 wherein said vertical columns are prominently numbered or designated from right to left and wherein the corresponding cell pairs are similarly numbered or designated to facilitate recording of column sums.

* * * * *